US010947104B2

(12) United States Patent
Chernov et al.

(10) Patent No.: US 10,947,104 B2
(45) Date of Patent: Mar. 16, 2021

(54) DISPENSE CONTROL SYSTEM FOR A REFRIGERATOR APPLIANCE

(71) Applicant: Haier US Appliance Solutions, Inc., Wilmington, DE (US)

(72) Inventors: Gregory Sergeevich Chernov, Louisville, KY (US); Andrew Reinhard Krause, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 16/243,280

(22) Filed: Jan. 9, 2019

(65) Prior Publication Data

US 2020/0216302 A1 Jul. 9, 2020

(51) Int. Cl.

| | |
|---|---|
| ***B67D 1/12*** | (2006.01) |
| ***F25D 23/02*** | (2006.01) |
| ***B67D 1/00*** | (2006.01) |
| ***F25C 5/20*** | (2018.01) |

(52) U.S. Cl.

CPC ..... *B67D 1/1202* (2013.01); *B67D 1/0003* (2013.01); *F25C 5/22* (2018.01); *F25D 23/028* (2013.01); *F25C 2400/10* (2013.01)

(58) Field of Classification Search

CPC ..... B67D 1/1202; B67D 1/0003; F25C 5/22; F25C 2400/10; F25D 23/028

See application file for complete search history.

(56) References Cited

U.S. PATENT DOCUMENTS 8,109,301 B1 2/2012 Denise
2018/0201492 A1* 7/2018 Jung ..... B67D 1/1238

FOREIGN PATENT DOCUMENTS

DE 102014217840 A1 * 3/2016 ..... G01F 23/292
KR 101830496 B1 2/2018

OTHER PUBLICATIONS

Ramesh Jain, Rangachar Kasturi, Brian G. Schunck, Machine Vision, 1995, McGraw-Hill, pp. 249-256 (Year: 1995).*

* cited by examiner

*Primary Examiner* — Craig M Schneider
*Assistant Examiner* — Jason K Niesz
(74) *Attorney, Agent, or Firm* — Dority & Manning, P.A.

(57) ABSTRACT

A dispense control system for a dispensing assembly of a refrigerator appliance and a method for operating the same are provided. The dispensing assembly defines a base plane for receiving a container. A dispense control system includes an emitter for directing a beam of energy toward the container and the base plane and a receiver for detecting a projection of the beam of energy in an image plane of the receiver. The dispense control system may be configured to obtain a measured displacement of the projection when the container is positioned on the base plane, and an actual height of the container or a liquid level within the container may be determined from the measured displacement of the projection.

13 Claims, 10 Drawing Sheets

DISPENSE CONTROL SYSTEM FOR A REFRIGERATOR APPLIANCE

FIELD OF THE INVENTION

The present subject matter relates generally to refrigerator appliances, and more particularly to dispense control systems for refrigerator appliances.

BACKGROUND OF THE INVENTION

Refrigerator appliances generally include a cabinet that defines a chilled chamber for receipt of food articles for storage. In addition, refrigerator appliances include one or more doors rotatably hinged to the cabinet to permit selective access to food items stored in chilled chamber(s). The refrigerator appliances can also include various storage components mounted within the chilled chamber and designed to facilitate storage of food items therein. Such storage components can include racks, bins, shelves, or drawers that receive food items and assist with organizing and arranging of such food items within the chilled chamber.

In addition, conventional refrigerator appliances include dispensing assemblies for dispensing liquid water and/or ice, e.g., through a dispenser mounted on a front of the appliance or within the cabinet. These dispensing assemblies typically operate by dispensing water and/or ice while a container is pressed against a paddle or the user is pressing a button to activate the dispenser. Certain dispensing assemblies also include features for filling containers with a specified volume of water or use other systems to fill a container to a specific level. However, such systems or features are typically complex and include costly moving parts, such as moving water level scanners or sensors. Thus, improvements in water level detection and container fill systems are generally desired.

Accordingly, a refrigerator appliance with an improved dispensing assembly would be useful. More particularly, a dispensing assembly for a refrigerator appliance which includes features for simply and precisely filling a container with water or ice would be particularly beneficial.

BRIEF DESCRIPTION OF THE INVENTION

Aspects and advantages of the invention will be set forth in part in the following description, or may be apparent from the description, or may be learned through practice of the invention.

In a first exemplary embodiment, a refrigerator appliance is provided including a cabinet defining a chilled chamber, a door being rotatably hinged to the cabinet to provide selective access to the chilled chamber, the door defining a dispenser recess, and a dispensing assembly positioned within the dispenser recess and defining a base plane. A dispense control system is operably coupled to the dispensing assembly for filling a container positioned on the base plane. The dispense control system includes an emitter for directing a beam of energy toward the container and the base plane and a receiver for detecting a projection of the beam of energy in an image plane of the receiver to obtain a measured displacement of the projection when the container is positioned on the base plane, and wherein an actual height of the container or a liquid level within the container is determined from the measured displacement of the projection.

According to another exemplary embodiment, a dispense control system for regulating a dispensing assembly to fill a container positioned on a base plane is provided. The dispense control system includes an emitter for directing a beam of energy toward the container and the base plane and a receiver for detecting a projection of the beam of energy in an image plane of the receiver to obtain a measured displacement of the projection when the container is positioned on the base plane, and wherein an actual height of the container or a liquid level within the container is determined from the measured displacement of the projection.

According to still another embodiment, a method of operating a dispense control system to fill a container positioned on a base plane of a dispensing assembly is provided. The method includes directing a beam of energy toward the base plane using an emitter, detecting a first projection of the beam of energy in an image plane of a receiver, and positioning the container on the base plane. The method further includes directing the beam of energy toward the container, detecting a second projection of the beam of energy in the image plane of the receiver, determining a measured displacement between the first projection and the second projection and obtaining an actual height of the container based at least in part on the measured displacement.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
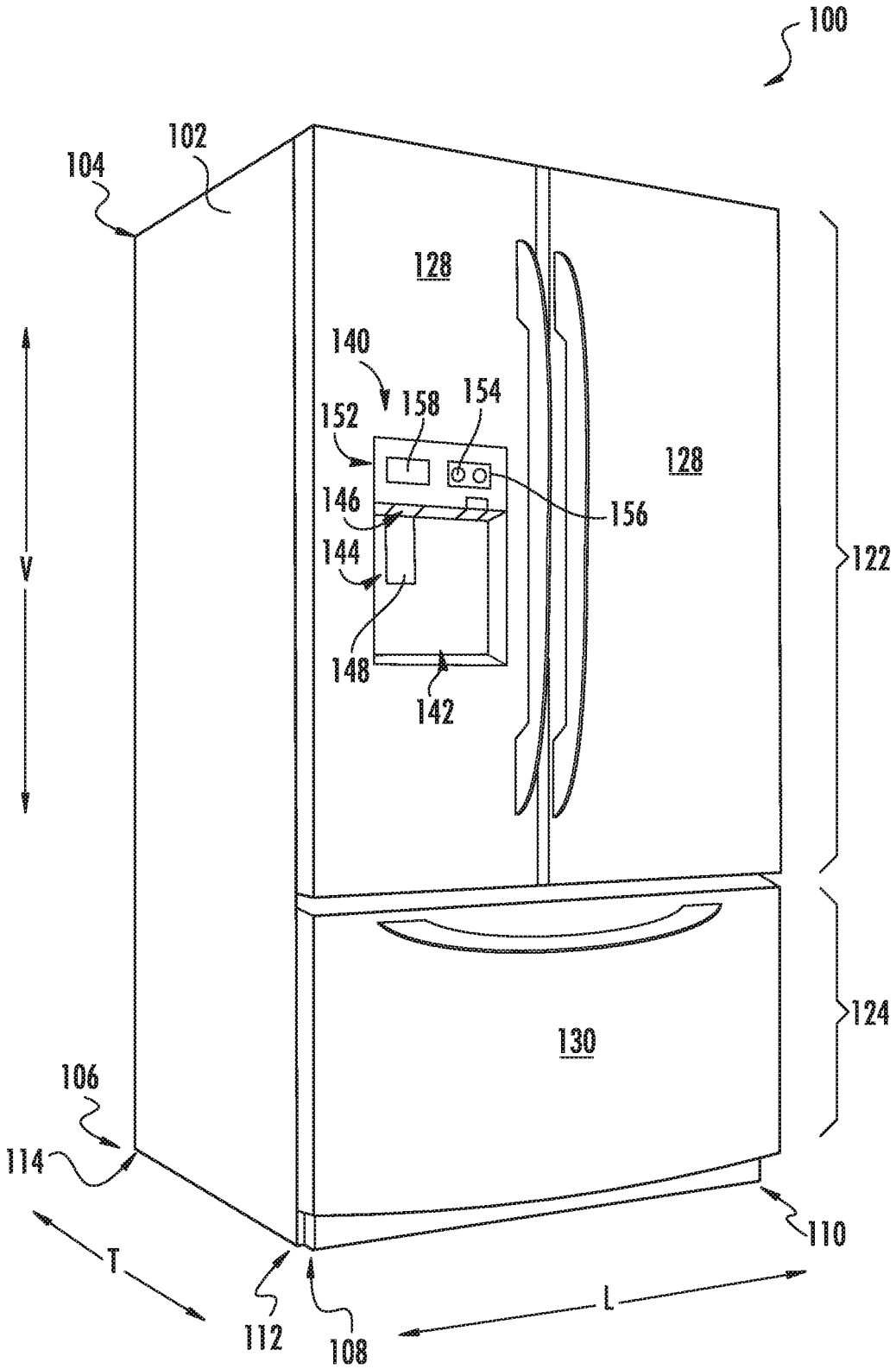
FIG. 1 provides a perspective view of a refrigerator appliance according to an exemplary embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a perspective view of a refrigerator appliance 100 according to an exemplary embodiment of the present subject matter. Refrigerator appliance 100 includes a cabinet or housing 102 that extends between a top 104 and a bottom 106 along a vertical direction V, between a first side 108 and a second side 110 along a lateral direction L, and between a front side 112 and a rear side 114 along a transverse direction T. Each of the vertical direction V, lateral direction L, and transverse direction T are mutually perpendicular to one another.

Housing 102 defines chilled chambers for receipt of food items for storage. In particular, housing 102 defines fresh food chamber 122 positioned at or adjacent top 104 of housing 102 and a freezer chamber 124 arranged at or adjacent bottom 106 of housing 102. As such, refrigerator appliance 100 is generally referred to as a bottom mount refrigerator. It is recognized, however, that the benefits of the present disclosure apply to other types and styles of refrigerator appliances such as, e.g., a top mount refrigerator appliance, a side-by-side style refrigerator appliance, or a single door refrigerator appliance. Moreover, aspects of the present subject matter may be applied to other appliances as well, such as other appliances including fluid dispensers. Consequently, the description set forth herein is for illustrative purposes only and is not intended to be limiting in any aspect to any particular appliance or configuration.

Refrigerator doors 128 are rotatably hinged to an edge of housing 102 for selectively accessing fresh food chamber 122. In addition, a freezer door 130 is arranged below refrigerator doors 128 for selectively accessing freezer chamber 124. Freezer door 130 is coupled to a freezer drawer (not shown) slidably mounted within freezer chamber 124. Refrigerator doors 128 and freezer door 130 are shown in the closed configuration in FIG. 1. One skilled in the art will appreciate that other chamber and door configurations are possible and within the scope of the present invention.

Figure 2:
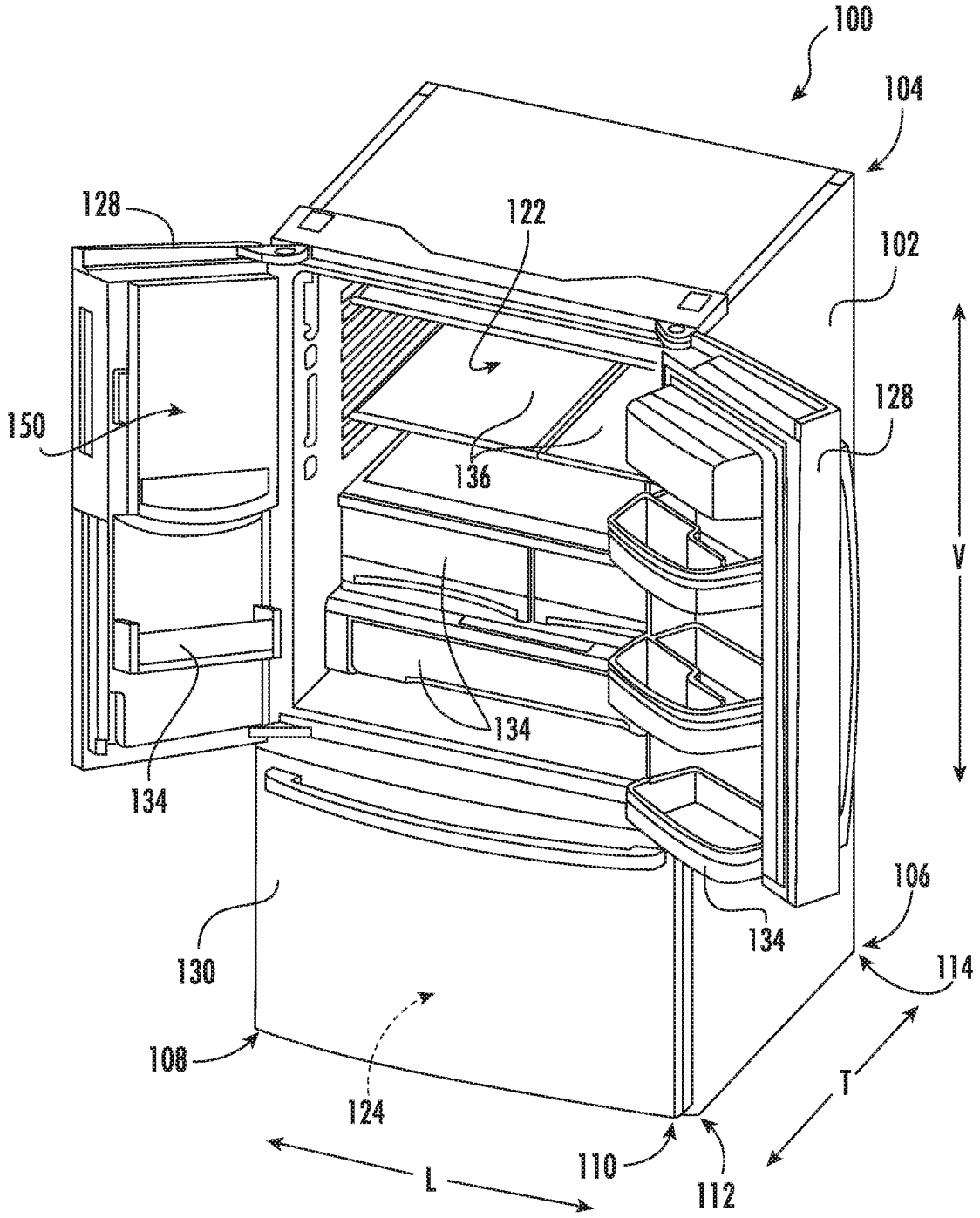
FIG. 2 provides a perspective view of the exemplary refrigerator appliance of FIG. 1, with the doors of the fresh food chamber shown in an open position.
Figure 3:
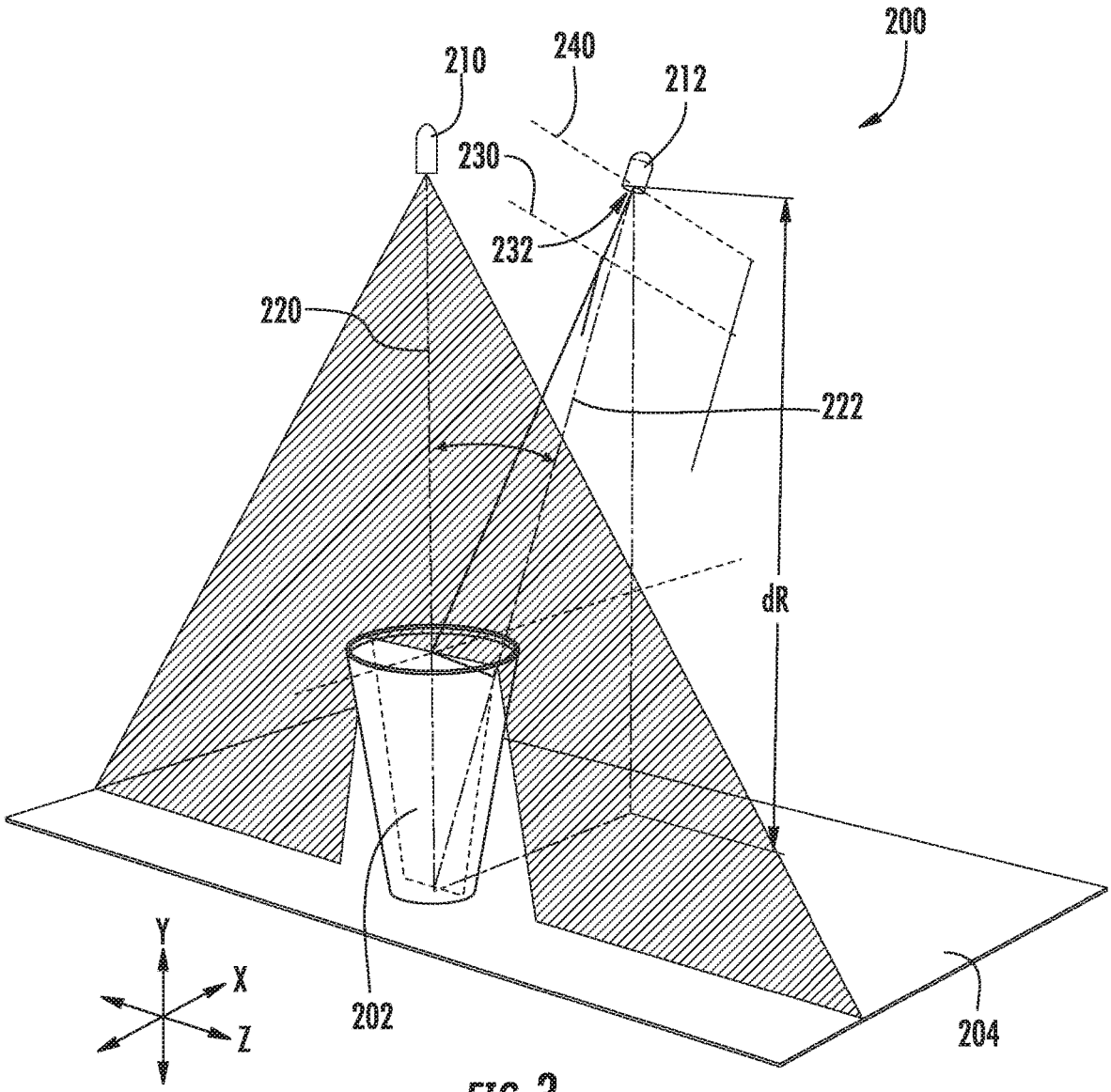
FIG. 3 provides a perspective view of a dispense control system that may be used with the exemplary refrigerator appliance of FIG. 1 according to an exemplary embodiment of the present subject matter.
Figure 4:
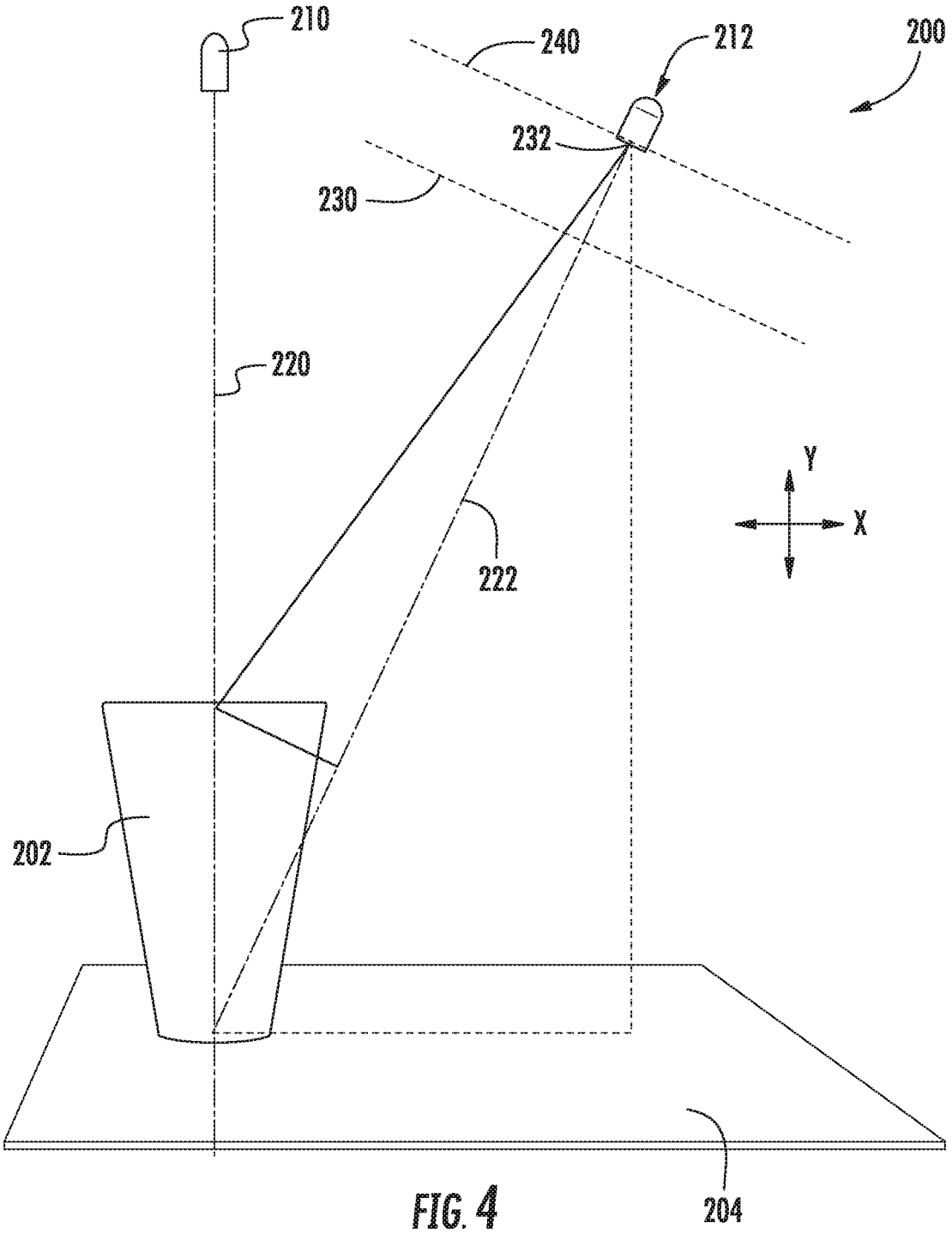
FIG. 4 provides a front view of the exemplary dispense control system of FIG. 3 according to an exemplary embodiment of the present subject matter.
Figure 5:
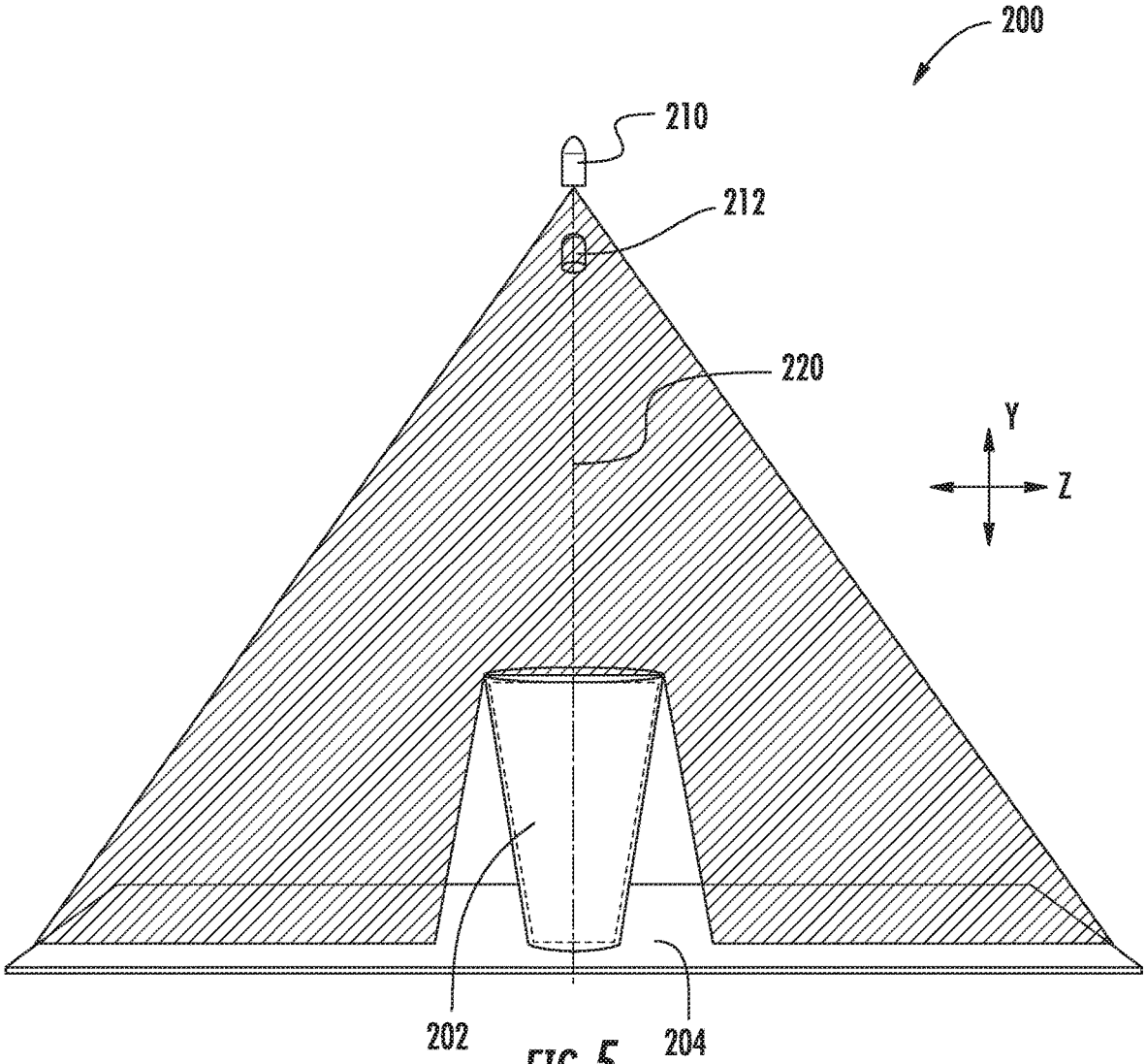
FIG. 5 provides a side view of the exemplary dispense control system of FIG. 3 according to an exemplary embodiment of the present subject matter.

FIG. 2 provides a perspective view of refrigerator appliance 100 shown with refrigerator doors 128 in the open position. As shown in FIG. 2, various storage components are mounted within fresh food chamber 122 to facilitate storage of food items therein as will be understood by those skilled in the art. In particular, the storage components may include bins 134 and shelves 136. Each of these storage components are configured for receipt of food items (e.g., beverages and/or solid food items) and may assist with organizing such food items. As illustrated, bins 134 may be mounted on refrigerator doors 128 or may slide into a receiving space in fresh food chamber 122. It should be appreciated that the illustrated storage components are used only for the purpose of explanation and that other storage components may be used and may have different sizes, shapes, and configurations.

Referring again to FIG. 1, a dispensing assembly 140 will be described according to exemplary embodiments of the present subject matter. Although several different exemplary embodiments of dispensing assembly 140 will be illustrated and described, similar reference numerals may be used to refer to similar components and features. Dispensing assembly 140 is generally configured for dispensing liquid water and/or ice. Although an exemplary dispensing assembly 140 is illustrated and described herein, it should be appreciated that variations and modifications may be made to dispensing assembly 140 while remaining within the present subject matter.

Dispensing assembly 140 and its various components may be positioned at least in part within a dispenser recess 142 defined on one of refrigerator doors 128. In this regard, dispenser recess 142 is defined on a front side 112 of refrigerator appliance 100 such that a user may operate dispensing assembly 140 without opening refrigerator door 128. In addition, dispenser recess 142 is positioned at a predetermined elevation convenient for a user to access ice and enabling the user to access ice without the need to bend-over. In the exemplary embodiment, dispenser recess 142 is positioned at a level that approximates the chest level of a user.

Dispensing assembly 140 includes an ice dispenser 144 including a discharging outlet 146 for discharging ice from dispensing assembly 140. An actuating mechanism 148, shown as a paddle, is mounted below discharging outlet 146 for operating ice or water dispenser 144. In alternative exemplary embodiments, any suitable actuating mechanism may be used to operate ice dispenser 144. For example, ice dispenser 144 can include a sensor (such as an ultrasonic sensor) or a button rather than the paddle. Discharging outlet 146 and actuating mechanism 148 are an external part of ice dispenser 144 and are mounted in dispenser recess 142. By contrast, refrigerator door 128 may define an icebox compartment 150 (FIG. 2) housing an icemaker and an ice storage bin (not shown) that are configured to supply ice to dispenser recess 142.

A control panel 152 is provided for controlling the mode of operation. For example, control panel 152 includes one or more selector inputs 154, such as knobs, buttons, touch-screen interfaces, etc., such as a water dispensing button and an ice-dispensing button, for selecting a desired mode of operation such as crushed or non-crushed ice. In addition, inputs 154 may be used to specify a fill volume or method of operating dispensing assembly 140. In this regard, inputs 154 may be in communication with a processing device or controller 156. Signals generated in controller 156 operate refrigerator appliance 100 and dispensing assembly 140 in response to selector inputs 154. Additionally, a display 158, such as an indicator light or a screen, may be provided on control panel 152. Display 158 may be in communication with controller 156, and may display information in response to signals from controller 156.

As used herein, "processing device" or "controller" may refer to one or more microprocessors or semiconductor devices and is not restricted necessarily to a single element.

The processing device can be programmed to operate refrigerator appliance 100, dispensing assembly 140 and other components of refrigerator appliance 100. The processing device may include, or be associated with, one or more memory elements (e.g., non-transitory storage media). In some such embodiments, the memory elements include electrically erasable, programmable read only memory (EEPROM). Generally, the memory elements can store information accessible processing device, including instructions that can be executed by processing device. Optionally, the instructions can be software or any set of instructions and/or data that when executed by the processing device, cause the processing device to perform operations.

Referring now generally to FIGS. 3 through 6, a dispense control system 200 which may be used with refrigerator appliance 100 will be described according to exemplary embodiments of the present subject matter. Specifically, dispense control system 200 may be used with dispensing assembly 140 of refrigerator appliance 100 to dispense a desired amount or level of water into a container 202, which may be a cup, utensil, pot, or other storage reservoir. In this regard, dispensing assembly 140 may define a surface for receiving container 202, referred to herein as a base plane 204, which may be positioned at the bottom of dispenser recess 142.

Dispense control system 200 is generally used to obtain simplified water level and container geometry measurements necessary to implement automatic dispense for a beverage machine (i.e., an autofill process). According to an exemplary embodiment, dispense control system 200 uses laser grid projection emitter and an image matrix receiver and uses a method of triangulation to create a simplified 3D representation of dispenser recess 142 and any container 202 positioned therein. Dispense control system 200 may also generally define an X-Y-Z coordinate system, in which the Z-direction corresponds substantially with the lateral direction L, the Y-direction corresponds substantially with the vertical direction V, and the X-direction corresponds substantially with the transverse direction T of refrigerator appliance 100.

According to the exemplary embodiment described and illustrated herein, dispense control system 200 is operably coupled to dispensing assembly 140. Specifically, dispense control system includes an emitter 210 and a receiver 212 positioned within or proximate to dispenser recess 142. Alternatively, dispense control system 200 may be mounted at any other suitable location within refrigerator appliance 100 or may be used in any other suitable refrigerator appliance or dispensing assembly where accurate fluid dispensing is desired. The exemplary embodiments described herein are not intended to limit the scope of the present subject matter in any manner.

In general, emitter 210 may be the source of any form of energy which may be measured or detected by receiver 212, e.g., for detecting the presence, location, geometry, and/or orientation of container 202 within dispensing recess 142. For example, according to the illustrated embodiment, emitter 210 and receiver 212 are an optical tracking system or laser tracking system. In this regard, for example, emitter 210 may include a laser diode (e.g., including one or more lenses and/or beam splitters) or other suitable energy source, and receiver 212 may include image matrix sensor (low resolution CMOS or similar) or other suitable detector or sensor. However, according to alternative embodiments, emitter 210 and receiver 212 may rely on principles of electromagnetism or other optical or sonar means for detecting positional and geometric data of container 202. Other devices for measuring this data are possible and within the scope of the present subject matter.

In general, emitter 210 is configured for generating and/or directing a point, line, 2D line or dot grid, a series of line or dot grids, or any other suitable laser profile, referred to herein as "energy beams," onto a support surface of dispensing assembly 140, e.g., onto base plane 204. Alternatively, when container 202 is positioned on base plane 204, the energy beams directed from emitter 210 may form a distorted image due to the presence of container 202. Receiver 212 is suitably positioned to detect or measure the projection of the energy beam(s), as described herein.

Specifically, referring to the embodiment illustrated in FIGS. 3 through 6, dispense control system 200 includes an emitter 210 which is installed above base plane 204 (e.g., proximate a top of dispenser recess 142) and defines an emitter axis 220 that is substantially orthogonal to base plane 204. In this regard, if emitter 210 directs an energy beam (whether linear or planar) along the emitter axis 220, that energy beam will also be orthogonal to base plane 204. In addition, according to the illustrated embodiment, receiver 212 is installed above base plane 204 (e.g., proximate a top of dispenser recess 142) and defines a receiver axis 222 that is not orthogonal to base plane 204. In this regard, receiver axis 222 is generally oriented at an angle relative to emitter axis 220, e.g., referred to herein as angle $\alpha$—a fixed geometric parameter of dispense control system 200.

Figure 6:
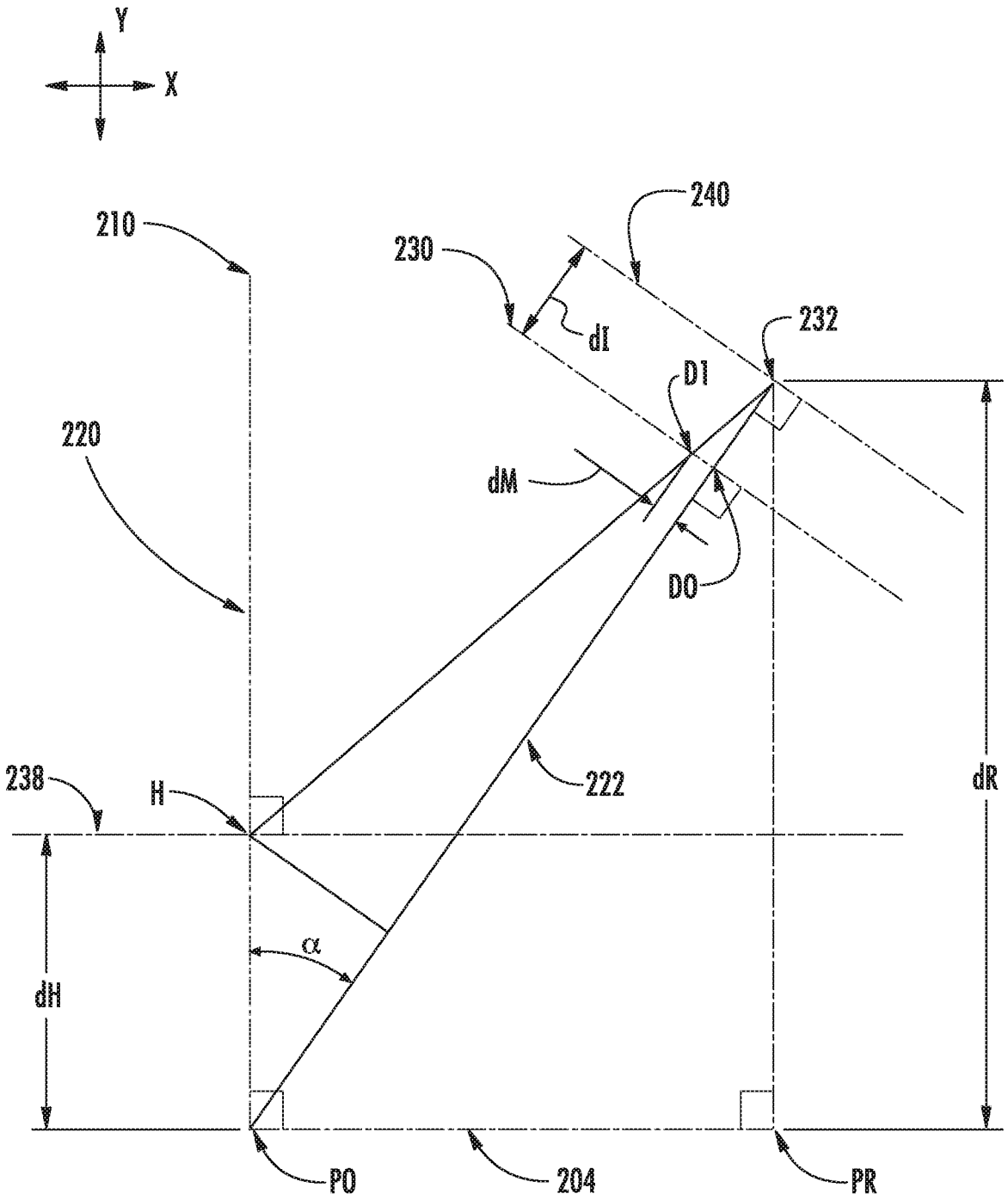
FIG. 6 provides a schematic view of the exemplary dispense control system of FIG. 3 detecting a cup or container.

The position of receiver 222 is fixed so that the projections on base plane 204 and on objects placed in dispenser recess 142, such as container 202, between base plane 204 and emitter 210 are in the field of view of receiver 212. In addition, as best illustrated in FIG. 6, emitter axis 220 and receiver axis 222 intersect substantially at base plane 204. It should be appreciated that as used herein, terms of approximation, such as "approximately," "substantially," or "about," refer to being within a ten percent margin of error.

Referring now specifically to FIG. 6, receiver 212 generally includes a focusing lens (not shown) which is placed in front of an image sensor and a detector matrix. Specifically, the detector matrix is located in an image plane 230 upon which a projection of base plane 204 and/or container 202 are imposed. According to the illustrated embodiment, image plane 230 is spaced apart from a focal point 232 of receiver 212 along receiver axis 222. Specifically, the distance between image plane 230 and focal point 232 is referred to herein as a focus distance, or dI (see FIG. 6).

In general, receiver 212 is configured to takes an image of a container and/or of the contents of a container. Specifically, according to one exemplary embodiment, a data processing algorithm (e.g., examples provided herein) considers only the brightest pixels of the image—the laser projected grid and all other visual information may be discarded and the data type can be reduced as logical to conserve on processing power and on memory. The image received by on image plane 230 of receiver 212 may be referred to herein generally as a "projection," and this projection may be used as described below to determine an actual height (referred to herein as dH) of container 202.

According to exemplary embodiments, receiver 212 take a reference image of the laser grid generated by emitter 210 before container 202 is placed into dispenser recess 142, e.g., onto base plane 204. When container 202 is placed on base plane 204, receiver 212 takes an image of the grid affected by container 202. Because the axes of receiver 212 (e.g., receiver axis 222) and emitter 210 (e.g., emitter axis 220) do not coincide, due to triangulation effect, the lines of the grid will be distorted as compared to the reference image (see FIG. 3). The magnitude of the distortion may generally be proportional to the magnitude of the emitter 210 and receiver 212 misalignment and the magnitude of the elevation of the corresponding part of container 202. Since the magnitude of the misalignment is fixed, the dimensions of container 202 can be calculated directly from the analysis of the distortion of corresponding grid lines. In order to detect the elevation of the rim of container 202, a simple edge detection algorithm can be implemented. The change of the water level will also distort the grid and the magnitude of the water level can be calculated. When dispense control system 200 determines that container 202 is full, the dispensing process may be terminated.

Figure 7:
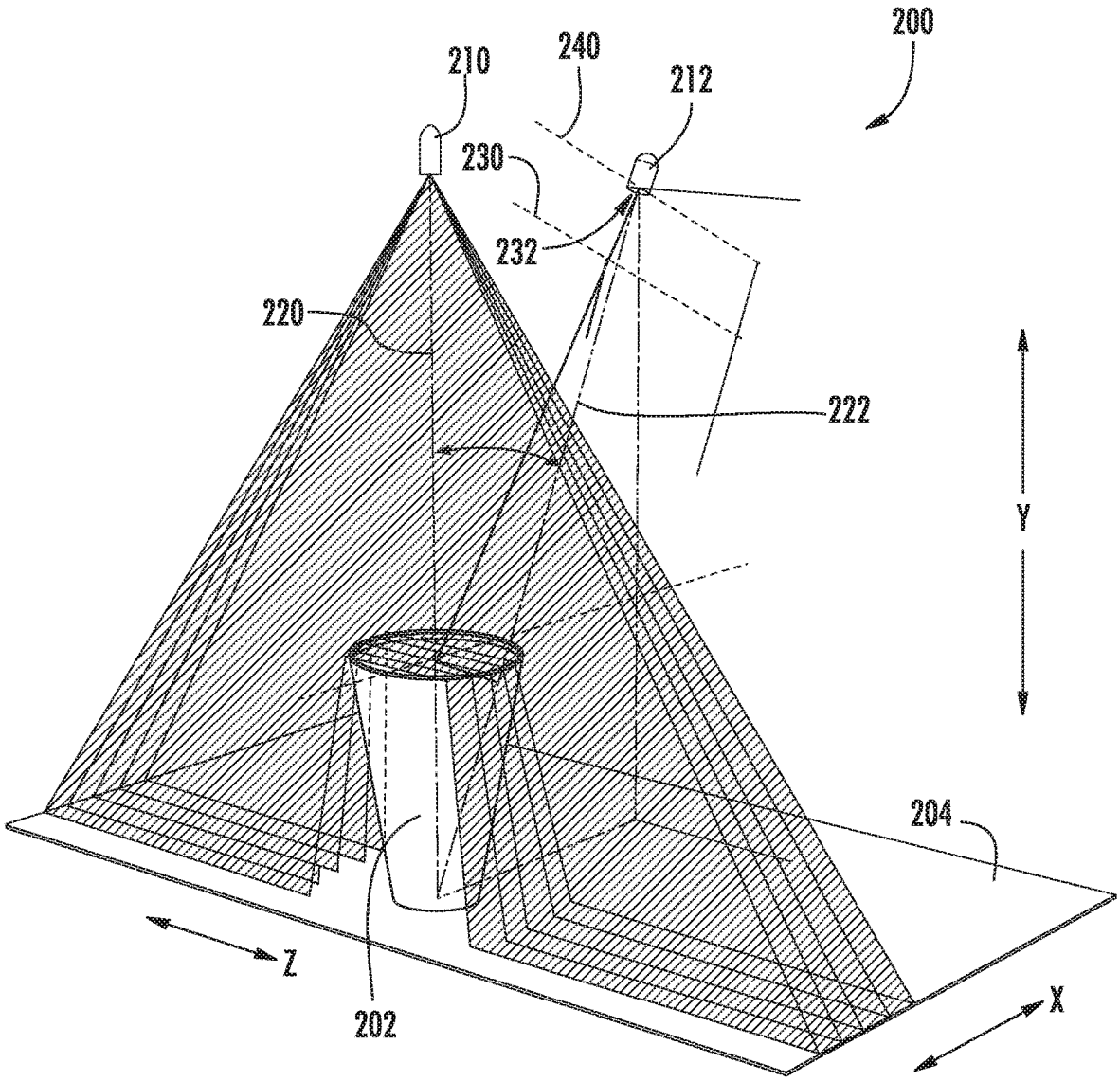
FIG. 7 provides a perspective view of the exemplary dispense control system of FIG. 3 detecting a cup using multiple projection planes according to an exemplary embodiment of the present subject matter.
Figure 8:
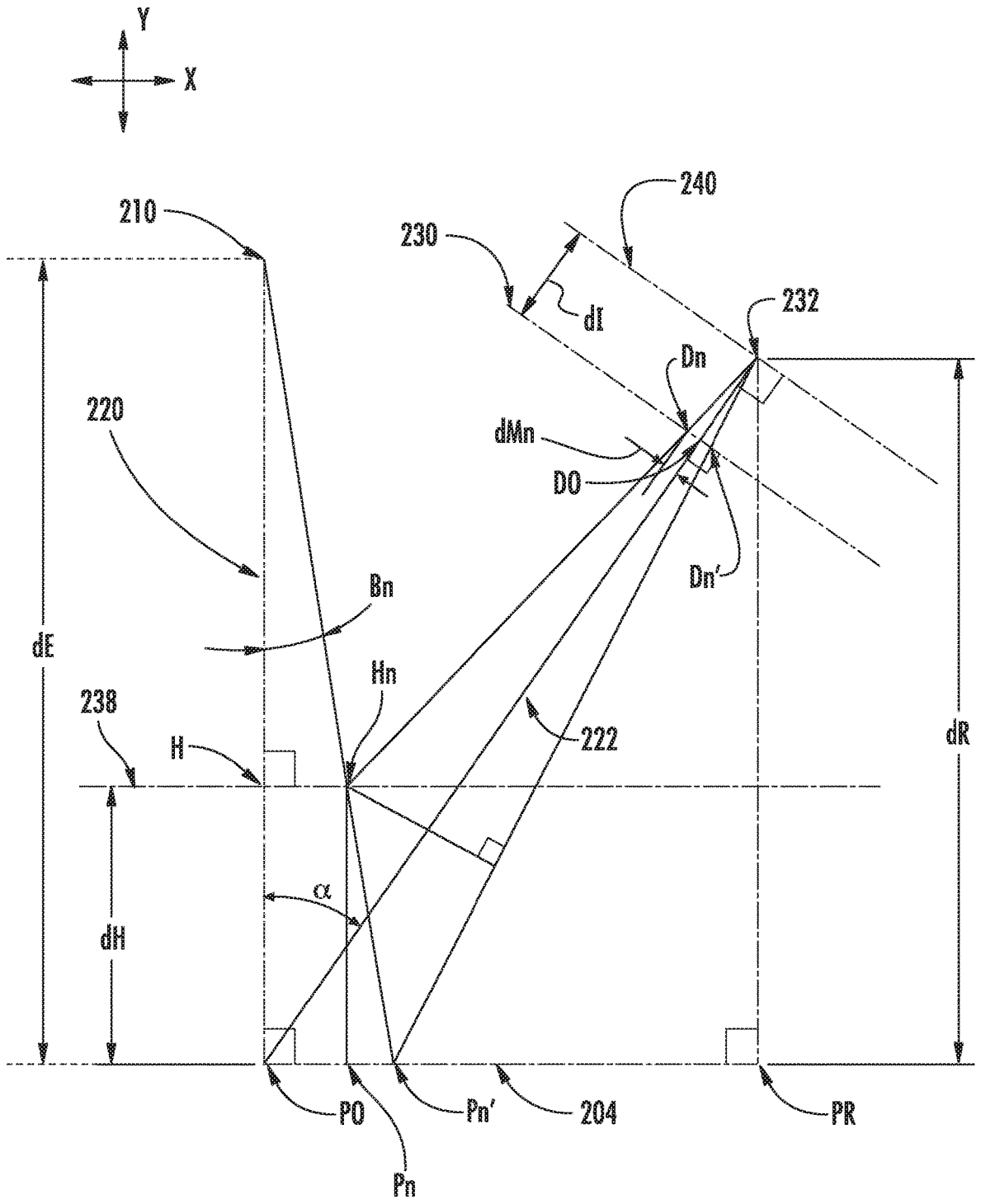
FIG. 8 provides a schematic view of the exemplary dispense control system of FIG. 3 detecting a cup or container using multiple projection planes.

Dispense control system 200 is described herein as obtaining the actual height of container 202 according a "simple case" which includes emitter 210 projecting an energy beam in a single plane (described herein with respect to FIGS. 3 through 6) and a more "general case" which includes emitter 210 projecting a plurality of energy beams at different angles relative to image plane 230 or emitter axis 220 (described herein with respect to FIGS. 7 and 8). In general, each of these cases or associated algorithms and detection methods provide optical compensation for perspective distortion and solve for changes in distances along a single line. Thus, the algorithms described herein may generally be configured for obtaining a measured displacement of a projection on image plane 230 when container 202 is positioned on base plane 204, and further determining actual height of container 202 or the level of liquid within container 202 from the measured displacement.

In addition, the general case algorithm provides geometric relations that could be used to solve for changes in distances and compensate for perspective distortion along multiple lines projected at different angles. These equations and models can be modified for use with different concepts including the calculation of the height as a function of the change of the distance between the projection lines; the change of the size of the projections as a function of the height; and to provide precise object measurements in additional dimensions, as described briefly below.

Referring now specifically to FIGS. 3 through 6, the "simple case" equations describe a basic system with a single projection plane. The equations presented below account for an optical compensation for the perspective distortion and solve for changes in distances along a single line. According to an exemplary embodiment, the laser projection is orthogonal to base plane 204 and XZ plane (see FIG. 3).

Referring now generally to FIG. 6, a schematic view of the operation of dispense control system 200 is illustrated, including labeling or identification of certain reference planes, geometric constants or system constraints, and measured/calculated variables for the simple case scenario. Specifically, FIG. 6 represents geometric parameters of dispense control system 200 projected onto an XY plane. It should be appreciated that the planes used herein to describe exemplary operation of dispense control system 200 may vary according to alternative embodiments and system configurations.

The point P0 is the point at which the emitted line or a plane projects onto base plane 204 (reference point when no additional object is placed above base plane 204). The point H is the point at which the line or a plane projected on an object (e.g., container 202) is measured (the height of the object). The point H defines a level plane 238 which includes point H and is parallel to base plane 204 and the XZ plane. The dimension P0_H (e.g., otherwise identified herein as dH) represents the actual height of an object such as container 202. Point 210 represents the location of emitter 210. Point 232 represents the location of the focal point 232 of receiver 212. A receiver plane 240 includes point 232 and is orthogonal to receiver axis 222. Dimension dR defines the Y-coordinate (e.g., the height) of receiver 212. Image plane 230 is a plane on which the image of the projections as viewed by the receiver 212 is formed. Image plane 230 is parallel to the receiver plane 240. The distance between image plane 230 and receiver plane 240, e.g., as measured along the receiver axis 222, is referred to herein as the focal distance or dI.

Point D0 defines the coordinates of the projection on base plane 204 (reference reading, no object present) measured (viewed) on the lens or at image plane 230 of receiver 212. Point D1 defines the coordinates of the projection on the object such as container 202 (e.g., corresponds to the height of container 202) as measured or viewed on image plane 230 of receiver 212. Thus, a measured displacement dM of the projection on image plane 230 which is caused by the introduction of the object or container 202 may be determined.

For a given system with fixed geometry the height dH of an object such as container 202 can be calculated as function of the measured displacement dM as follows:

$$dH = \frac{dR \cdot dM}{dM \cdot \cos(\alpha)^2 + dI \cdot \sin(\alpha) \cdot \cos(\alpha)}$$

where:

dH=the actual height of the container;

dR=a height of the receiver measured from the base plane;

dM=the measured displacement of the projection in the image plane when the container is positioned on the base plane;

dI=a distance between a focal point of the receiver and the image plane measured along a receiver axis; and α=an angle between an emitter axis and the receiver axis.

Referring now specifically to FIGS. 7 and 8, the "general case" equations describe a complex system with multiple projection planes. The equations presented below account for an optical compensation for the perspective distortion and solve for changes in distances along multiple lines. According to exemplary embodiments, the laser projections from emitter 210 do not have to be orthogonal to the base plane and XZ plane (only one projection can be orthogonal).

According to exemplary embodiments, emitter 210 projects multiple linear or planar (in this embodiment) energy beams (only one can propagate along the emitter axis 220 and be parallel to YZ plane) in the direction of base plane 204. Each plane n, when projected on to the plane XY, defines an angle, referred to herein as βn with respect to emitter axis (see FIG. 8).

Referring now generally to FIG. 8, a schematic view of the operation of dispense control system 200 is illustrated, including labeling or identification of certain reference planes, geometric constants or system constraints, and measured/calculated variables. Specifically, FIG. 8 shown these geometric parameters projected onto XY plane. Each of these planes, points, parameters, etc. will now be described according to an exemplary embodiment of the present subject matter. Similar, reference numerals or letters may be used to describe similar features between FIGS. 6 and 8.

The point represents an intersection of the projection n with base plane 204. The point Hn represent an intersection of the projection n with the level plane 238. The point Pn is a projection of point Hn on to base plane 204 (Pn' equivalent without accounting for perspective distortion). The angle beta (βn) is an angle between the projection n and emitter axis 220. Point 210 is the location of emitter 210. dE is the height of emitter 210 relative to base plane 204. The point Dn locates the coordinates of the projection n on an object (corresponds to the height of the object) on image plane 230. The point Dn' locates the coordinates of the projection n on base plane 204 on image plane 230. dMn is the measured displacement of the projection on image plane 230 caused by an introduction of the object, such as container 202.

For a given system with fixed geometry the height dH of an object such as container 202 can be calculated as function of the measured displacement dMn (for each plane n) as follows:

$$dH = B \cdot \frac{\sin(A + D)}{\sin(C + D)}$$

where:

$dH$ = the actual height of the container;

$$A = \alpha + \tan^{-1}\left(\frac{dE \cdot \tan(\beta_n) - dR \cdot \tan(\alpha)}{dR}\right);$$

$$B = dR \cdot \cos(\beta_n) \cdot \sqrt{\frac{(dE \cdot \tan(\beta_n) - dR \cdot \tan(\alpha))^2}{dR^2} + 1};$$

$$C = \alpha + \beta_n;$$

$$D = \tan^{-1}\left(\frac{dM_n}{dI}\right);$$

$\alpha$ = an angle between an emitter axis and a receiver axis;

$dE$ = a height of the emitter measured from the base plane;

$\beta_n$ = angle of the *nth* beam of the plurality of planar energy beams relative to the emitter axis;

$dR$ = a height of the receiver measured from the base plane;

$dM_n$ = the measured displacement of the projection in the image plane when the container is positioned on the base plane for an *nth* of the plurality of planar energy beams; and $dI$ = a distance between a focal point of the receiver and the image plane measured along the receiver axis.

The exemplary control algorithms described above generally facilitate the measurement of a height of a container or the liquid therein to improve autofill processes. The algorithms typically include variety of input parameters, such as geometric constraints of the dispense control system 200, measured variables or distances, and any other suitable constants of values. Trigonometric functions and relationships are used to translate what is measured "seen" by receiver 212 into the actual dimension or position of container 202 or its contents.

Specifically, for the multiple plane projection or general case illustrated in FIGS. 7 and 8, one measured parameter (e.g., the height of container 202 measured in an image plane for each projection, $dM_n$) and 5 fixed geometric parameters (e.g., α, β, dR, dI, dE) are used to calculate dH using the associated algorithm. However, although the stated parameters and exemplary algorithms are used to determine the height of the container in the exemplary embodiment, similar results can be achieved by using alternative, fixed, or controlled inputs and the analysis presented herein. Such alternative algorithms and inputs are considered to be within the scope of the present subject matter.

As one skilled in the art will appreciate, the above described embodiments are used only for the purpose of explanation. Modifications and variations may be applied, other configurations may be used, and the resulting configurations may remain within the scope of the invention. For example, dispense control system 200 may be positioned at any suitable location, emitter 210 and receiver 212 positioning may vary, alternative geometric and trigonometric relationships may be defined, and dispense control system 200 may operate in any other suitable manner. One skilled in the art will appreciate that such modifications and variations may remain within the scope of the present subject matter.

For example, dispense control system 200 and the associated algorithms described with respect to FIGS. 6 and 8 can be modified and used to determine dimensions or positioning of objects in other applications. For example, dispense control system 200 may generally be used to determine the level (height) of an object as a function of the change of the distance between projected lines. Alternatively, dispense control system 200 may be used to determine the level (height) of an object as a function of dimensional distortion of a projected object. In this regard, laser optics allows a projection on 2 dimensional shapes. The dimensions of the projected shapes will change as a function on the distance to the projector and the angle of view and the height can be calculated from the image using the same methodology. Furthermore, dispense control system 200 may generally be used to determine the Z and X coordinates of an object (e.g., in addition to the height along the Y-direction).

Now that the construction and configuration of refrigerator appliance 100 and dispense control system 200 have been presented according to an exemplary embodiment of the present subject matter, an exemplary method 300 for operating a dispense control system is provided. Method 300 can be used to operate dispense control system 200, or to operate any other suitable dispensing assembly. In this regard, for example, controller 156 may be configured for implementing method 300. However, it should be appreciated that the exemplary method 300 is discussed herein only to describe exemplary aspects of the present subject matter, and is not intended to be limiting.

Figure 9:
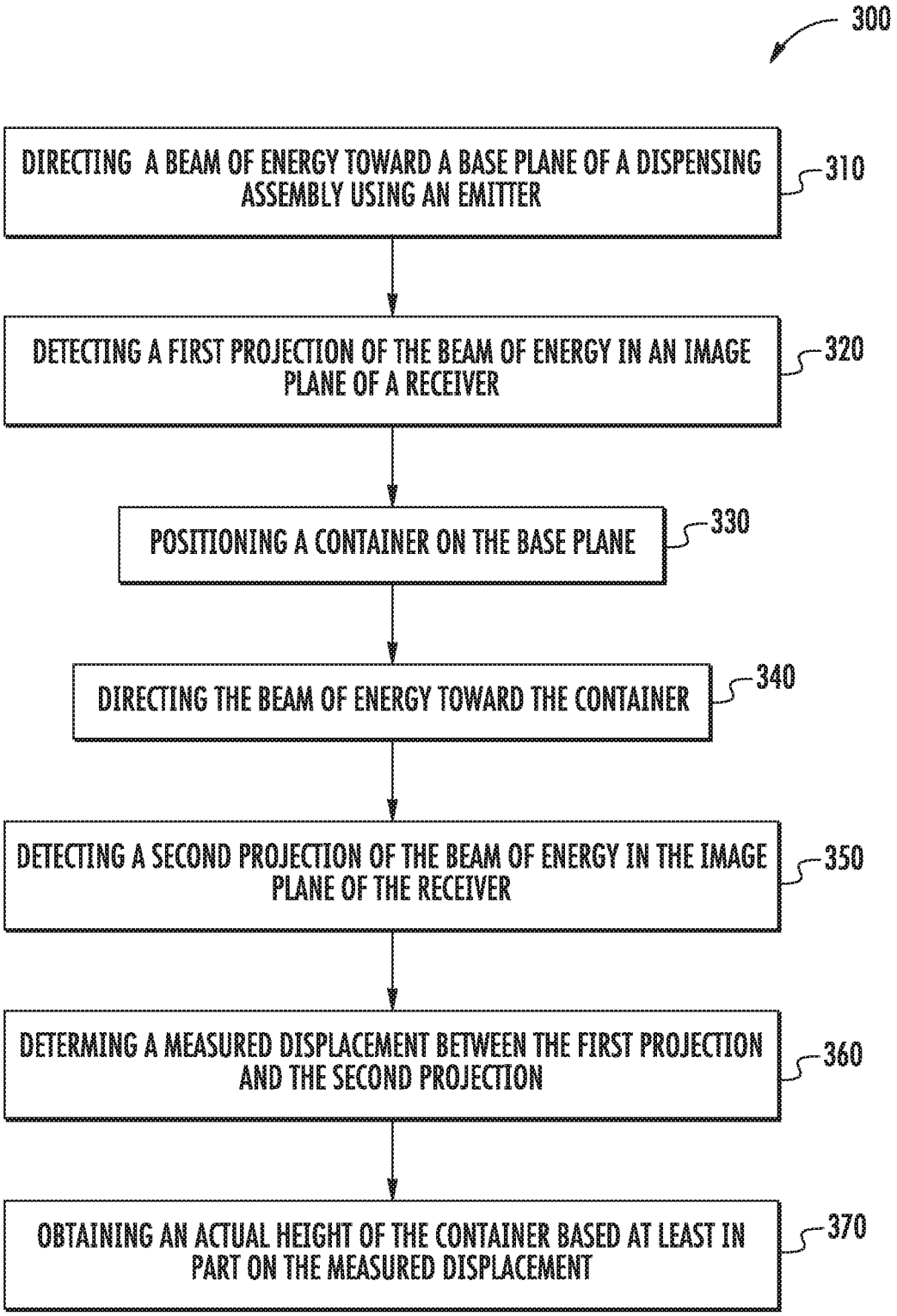
FIG. 9 provides a method for operating a dispense control system for determining a height of a container according to an exemplary embodiment of the present subject matter.

As shown in FIG. 9, method 300 includes, at step 310, directing a beam of energy toward a base plane of a dispensing assembly using an emitter. For example, emitter 210 may direct a single or multiple planar beams of energy toward base plane 204. Step 320 includes detecting a first projection of the beam of energy in an image plane of a receiver. In this regard, a base image may be made and associated with an empty dispenser recess 142 using receiver 212 which defines image plane 230. Notably, this step may be omitted, performed a single time upon appliance initiation/power up, or may be set by the manufacturer.

Step 330 includes positioning a container on the base plane and step 340 includes directing the beam of energy toward the container. Step 350 includes detecting a second projection of the beam of energy in the image plane of the receiver (e.g., in a manner similar to step 320). Step 360 includes determining a measured displacement between the first projection and the second projection. Step 370 includes obtaining an actual height of the container based at least in part on the measured displacement. Specifically, according to an exemplary embodiment, the actual height (dH) may be calculated according to one of the simple case and general case equations described above. The actual height may then be used to accurately fill container 202, e.g., using controller 156 and dispensing assembly 140 (e.g., as described in FIG. 10).

Although the exemplary embodiment described herein focuses primarily on determining an actual height of container 202 from the measured displacement dM of a projected image on image plane 230 of receiver 212, it should be appreciated that the present method may further be used to measure other heights or levels as well. For example, according to alternative embodiments, method 300 may be used to obtain the measured displacement of a projection of the water level within container 202. In this regard, as the water level within container 202 rises during a fill process, the measured displacement also increases until the measured displacement due to the water level is identical to the measured displacement of the container 202 (e.g., when container 202 is filled). In this manner, controller 156 may be used to determine the actual height of container 202 (e.g., as described above), monitor the height of water within container 202 during a fill process, and terminate the fill process when the water level has reached the top of container 202 (or any other suitable fill level).

Figure 10:
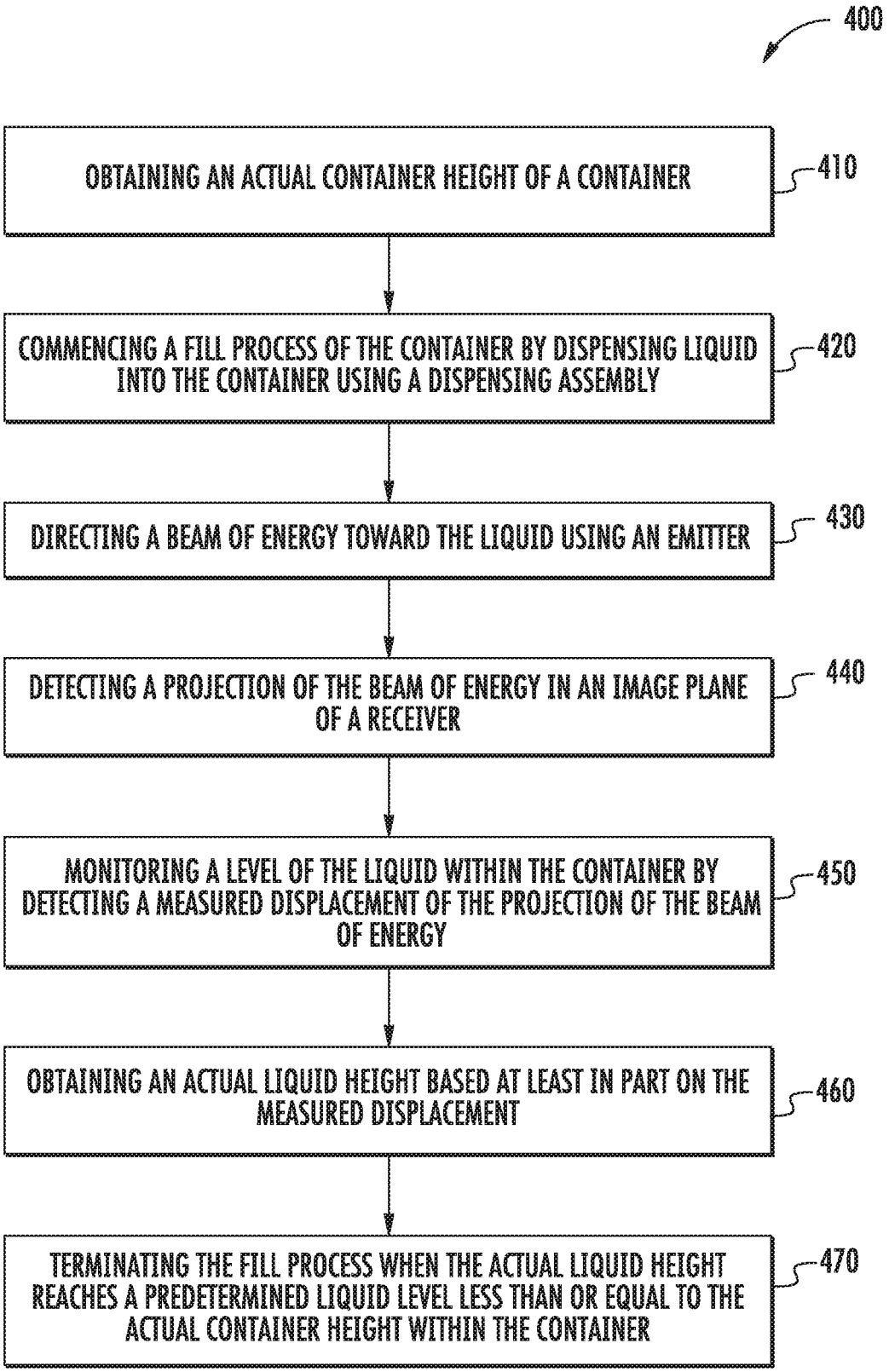
FIG. 10 provides a method for performing an exemplary fill process of a container using a dispense control system according to an exemplary embodiment of the present subject matter.

For example, an exemplary fill process is illustrated in FIG. 10. Specifically, method 400 includes, at step 410, obtaining an actual container height of a container. In this regard, for example, method 300 may be used to determine the container height as described above, or any other suitable edge detection or height determining algorithm may be used. Step 420 includes commencing a fill process of the container by dispensing liquid into the container using a dispensing assembly.

Step 430 includes directing a beam of energy toward the liquid using an emitter and step 440 includes detecting a projection of the beam of energy in an image plane of a receiver. Similar to method 300, method 400 includes, at step 450 monitoring a level of the liquid within the container by detecting a measured displacement of the projection of the beam of energy. Step 460 includes obtaining an actual liquid height based at least in part on the measured displacement. Specifically, according to an exemplary embodiment, the actual liquid height (dH) may be calculated according to one of the simple case and general case equations described above. Step 470 includes terminating the fill process when the actual liquid height reaches a predetermined liquid level less than or equal to the actual container height within the container.

FIGS. 9 and 10 depict exemplary control methods having steps performed in a particular order for purposes of illustration and discussion. Those of ordinary skill in the art, using the disclosures provided herein, will understand that the steps of any of the methods discussed herein can be adapted, rearranged, expanded, omitted, or modified in various ways without deviating from the scope of the present disclosure. Moreover, although aspects of the methods are explained using dispense control system 200 as an example, it should be appreciated that these methods may be applied to the operation of any suitable appliance and/or dispensing assembly.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance comprising:

a cabinet defining a chilled chamber;

a door being rotatably hinged to the cabinet to provide selective access to the chilled chamber, the door defining a dispenser recess;

a dispensing assembly positioned within the dispenser recess and defining a base plane; and a dispense control system operably coupled to the dispensing assembly for filling a container positioned on the base plane, the dispense control system comprising:

an emitter for directing a plurality of planar energy beams at different angles relative to an emitter plane toward the container and the base plane, wherein the emitter is installed above the base plane and defines the emitter plane that is orthogonal to the base plane; and a receiver installed above the base plane and defining a receiver axis that is not orthogonal to the base plane and intersects the emitter plane at the base plane, the receiver being configured for detecting a projection of the plurality of planar energy beams in an image plane of the receiver to obtain a measured displacement of the projection when the container is positioned on the base plane, and wherein an actual height of the container or a liquid level within the container is determined from the measured displacement of the projection.

2. The refrigerator appliance of claim 1, wherein the actual height of the container or the liquid level within the container is determined using the following equation:

$$dH=dR\cdot dM/dM\cdot\cos(\alpha)^2+dI\cdot\sin(\alpha)\cdot\cos(\alpha)$$

where:

dH=the actual height of the container;

dR=a height of the receiver measured from the base plane;

dM=the measured displacement of the projection in the image plane when the container is positioned on the base plane;

dI=a distance between a focal point of the receiver and the image plane measured along a receiver axis; and $\alpha$=an angle between an emitter axis and the receiver axis.

3. The refrigerator appliance of claim 1, wherein the actual height of the container or the liquid level within the container is determined using the following equation:

$$dH=B\cdot\sin(A+D)/\sin(C+D)$$

where:

dH=the actual height of the container;

$A=\alpha+\tan^{-1}(dE\cdot\tan(\beta_n)-dR\cdot\tan(\alpha)/dR)$;

$B=dR\cdot\cos(\beta_n)\cdot\sqrt{(dE\cdot\tan(\beta_n)-dR\cdot\tan(\alpha))^2/dR^2+1}$;

$C=\alpha+\beta_n$;

$D=\tan^{-1}(dM_n/dI)$;

$\alpha$=an angle between an emitter axis and a receiver axis;

dE=a height of the emitter measured from the base plane;

$\beta_n$=angle of the nth beam of the plurality of planar energy beams relative to the emitter axis;

dR=a height of the receiver measured from the base plane;

$dM_n$=the measured displacement of the projection in the image plane when the container is positioned on the base plane for an nth of the plurality of planar energy beams; and dI=a distance between a focal point of the receiver and the image plane measured along the receiver axis.

4. The refrigerator appliance of claim 1, wherein the emitter is a laser and the receiver is an optical image receiver.

5. A dispense control system for regulating a dispensing assembly to fill a container positioned on a base plane, the dispense control system comprising:

an emitter installed above the base plane for directing a plurality of planar energy beams at different angles relative to an emitter plane toward the container and the base plane; and a receiver installed above the base plane and defining a receiver axis, a focal point, and an image plane spaced apart from the focal point along the receiver axis, wherein the receiver is configured for detecting a projection of the plurality of planar energy beams in the image plane to obtain a measured displacement of the projection when the container is positioned on the base plane, and wherein an actual height of the container or a liquid level within the container is determined from the measured displacement of the projection.

6. The dispense control system of claim 5, wherein the actual height of the container or the liquid level within the container is determined using the following equation:

$$dH=dR\cdot dM/dM\cdot\cos(\alpha)^2+dI\cdot\sin(\alpha)\cdot\cos(\alpha)$$

where:

dH=the actual height of the container;

dR=a height of the receiver measured from the base plane;

dM=the measured displacement of the projection in the image plane when the container is positioned on the base plane;

dI=a distance between a focal point of the receiver and the image plane measured along a receiver axis; and α=an angle between an emitter axis and the receiver axis.

7. The dispense control system of claim 5, wherein the actual height of the container or the liquid level within the container is determined using the following equation:

$$dH=B\cdot\sin(A+D)/\sin(C+D)$$

where:

dH=the actual height of the container;

$A=\alpha+\tan^{-1}(dE\cdot\tan(\beta_n)-dR\cdot\tan(\alpha)/dR)$;

$B=dR\cdot\cos(\beta_n)\cdot\sqrt{(dE\cdot\tan(\beta_n)-dR\cdot\tan(\alpha))^2/dR^2+1}$;

$C=\alpha+\beta_n$;

$D=\tan^{-1}(dM_n/dI)$;

α=an angle between an emitter axis and a receiver axis;

dE=a height of the emitter measured from the base plane;

$\beta_n$=angle of the nth beam of the plurality of planar energy beams relative to the emitter axis;

dR=a height of the receiver measured from the base plane;

$dM_n$=the measured displacement of the projection in the image plane when the container is positioned on the base plane for an nth of the plurality of planar energy beams; and dI=a distance between a focal point of the receiver and the image plane measured along the receiver axis.

8. The dispense control system of claim 5, wherein the emitter plane is orthogonal to the base plane.

9. The dispense control system of claim 8, wherein the receiver axis is not orthogonal to the base plane.

10. The dispense control system of claim 9, wherein the emitter plane intersects the receiver axis at the base plane.

11. A method of operating a dispense control system to fill a container positioned on a base plane of a dispensing assembly, the method comprising:

directing a plurality of planar energy beams at different angles relative to an emitter plane toward the base plane using an emitter;

detecting a first projection of the plurality of planar energy beams in an image plane of a receiver, the image plane being spaced apart from a focal point of the receiver along a receiver axis;

positioning the container on the base plane;

directing the plurality of planar energy beams at different angles relative to an emitter plane toward the container or liquid within the container;

detecting a second projection of the plurality of planar energy beams in the image plane of the receiver;

determining a measured displacement between the first projection and the second projection; and obtaining an actual height of the container or a liquid level within the container based at least in part on the measured displacement.

12. The method of claim 11, wherein obtaining the actual height of the container or a liquid level within the container comprises using the following equation:

$$dH=dR\cdot dM/dM\cdot\cos(\alpha)^2+dI\cdot\sin(\alpha)\cdot\cos(\alpha)$$

where:

dH=the actual height of the container;

dR=a height of the receiver measured from the base plane;

dM=the measured displacement of the projection in the image plane when the container is positioned on the base plane;

dI=a distance between a focal point of the receiver and the image plane measured along a receiver axis; and α=an angle between an emitter axis and the receiver axis.

13. The method of claim 11, wherein obtaining the actual height of the container or the liquid level within the container comprises using the following equation:

$$dH=B\cdot\sin(A+D)/\sin(C+D)$$

where:

dH=the actual height of the container;

$A=\alpha+\tan^{-1}(dE\cdot\tan(\beta_n)-dR\cdot\tan(\alpha)/dR)$;

$B=dR\cdot\cos(\beta_n)\cdot\sqrt{(dE\cdot\tan(\beta_n)-dR\cdot\tan(\alpha))^2/dR^2+1}$;

$C=\alpha+\beta_n$;

$D=\tan^{-1}(dM_n/dI)$;

α=an angle between an emitter axis and a receiver axis;

dE=a height of the emitter measured from the base plane;

$\beta_n$=angle of the nth beam of the plurality of planar energy beams relative to the emitter axis;

dR=a height of the receiver measured from the base plane;

$dM_n$=the measured displacement of the projection in the image plane when the container is positioned on the base plane for an nth of the plurality of planar energy beams; and dI=a distance between a focal point of the receiver and the image plane measured along the receiver axis.

* * * * *